United States Patent [19]

Lund et al.

[11] 4,342,432

[45] Aug. 3, 1982

[54] CONTROL SYSTEM FOR SLITTER-REWINDER APPARATUS

[76] Inventors: Arnold M. Lund; Morten A. Lund, both of 906 Boardwalk, San Marcos, Calif. 92069

[21] Appl. No.: 229,662

[22] Filed: Jan. 30, 1981

[51] Int. Cl.[3] ..... B65H 35/02

[52] U.S. Cl. ..... 242/56.2; 242/56.4; 242/56.7; 318/6

[58] Field of Search ..... 242/56.2, 56.3, 56.4, 242/56.5, 56.7, 56.9; 318/5, 6

[56] References Cited

U.S. PATENT DOCUMENTS

| | | | |
|---|---|---|---|
| 2,678,174 | 5/1954 | Wilson | 318/6 |
| 3,185,908 | 5/1965 | Hollis | 242/56.2 X |
| 4,238,082 | 12/1980 | Lund | 242/56.2 |

*Primary Examiner*—Edward J. McCarthy
*Attorney, Agent, or Firm*—Brown & Martin

[57] ABSTRACT

A control system for a slitter-rewinder apparatus which forms a web of material into a plurality of individual rolls, the web being unwound from around a supply core and slit into strips which are rewound about a plurality of individual product cores. The slitter-rewinder apparatus has at least one takeup roller adapted to slidably receive the product cores there about. The supply core and the takeup roller are rotatably supported in spaced apart relationship with a portion of the web extending therebetween, around at least one idler roller and past a plurality of knives which cut the web into strips. The slitter-rewinder apparatus further has a first controllable motor for rotating the takeup roller and a second controllable motor for rotating the supply core. The control system includes a sensor for detecting the rotational speed of the product cores. The system also has control mechanisms responsive to the sensor for operating the second motor to cause the speed of the supply core to automatically increase and decrease in order to maintain a predetermined relationship between the speed of the product cores and the speed of the takeup roller throughout the rewinding process.

7 Claims, 2 Drawing Figures

CONTROL SYSTEM FOR SLITTER-REWINDER APPARATUS

BACKGROUND OF THE INVENTION

The present invention relates to apparatus for forming a web of material into a plurality of individual rolls. More particularly, the present invention relates to a control system for a slitter-rewinder apparatus which insures that light weight stretchable web materials are evenly wound into precise rolls with a minimum amount of material distortion.

Relatively thin sheet materials such as film, foil, paper, laminate and cloth are typically manufactured in the form of wide, long webs, which may measure, for example, six feet in width by one thousand feet in length. Each web is usually wound about an elongate cylindrical supply core for transport and storage. The manufacture of consumer products from such webs, for example rolls of adhesive tape, usually involves the use of an apparatus known as a slitter-rewinder. Examples of this type of apparatus are currently manufactured by Voorwood Company, 2350 Barney Street, Anderson, Calif., 96007 and Arrow Converting Equipment, Inc., Law Drive, Fairfield, N.J., 07006.

Known slitter-rewinder apparatus typically include an upright frame which supports a pair of powered takeup rollers and a supply roller or chuck for rotatably supporting the supply core and supply roll. During the rewinding operation, the web is guided by idler rollers from around the supply core past a series of slitting blades. The resulting strips of web material are rewound about a plurality of corresponding product cores on opposite ones of the takeup rollers in alternating fashion to give the necessary clearance between adjacent product rolls during their formation.

Heretofore, known slitter-rewinder apparatus have typically utilized the powered takeup rollers for pulling the web material from around the supply core. This latter core has not been directly powered but has been rotated only through the pulling action supplied by the takeup rollers. An adjustable drag brake, usually of the disc type, has been utilized to prevent over-spinning of the supply roll. The disc brake has also been used to attempt to maintain the tension necessary for proper slitting and rewinding.

The aforementioned type of slitter-rewinder apparatus is used as follows. The product cores are slid over the takeup rollers with spacers splined to the takeup rollers positioned between adjacent product cores. Pneumatic means are utilized to compress the product cores endwise against the spacers with a predetermined amount of pressure. At the start of the rewinding operation, the supply core is initially fully braked to prevent rotation thereof. The takeup rollers are rotated within the stationary product cores which are held in position because of their attachment to the non-moving strips of the web material. The brake on the supply core is then gradually released manually, or automatically by means of a sensing device known as a dancer roll tension control. Eventually, the friction between the product cores and the spacers is sufficient to cause the product cores to rotate and rewind the strips. The speed of rotation of the product cores increases as the brake is further released.

Heretofore with the type of slitter-rewinder apparatus described above, it has been difficult to precisely control the tension of the web portion extending between the supply and product cores to insure proper slitting and rewinding. This is especially true in the case of lightweight stretchable web materials such as acetate. Generally, a relatively great amount of pulling force and resulting web tension are required to unwind the web from around the supply core. The amount of pulling force required increases as the diameter of the web around the supply core decreases and the resulting leverage is reduced. If the disc brake is released too quickly to compensate for the increased pulling forces required, then over-spinning occurs and the strips of web material weave laterally. The resulting product rolls are not uniformally edge aligned, but instead have a telescoping or other undesirable configuration. If the brake is released too slowly, then the web tension is too great and the material stretches. The resulting product rolls then have a slightly smaller intermediate diameter than edge diameter. When the strips are unrolled from these product rolls, they are distorted and frequently have undulating side edges. This problem is particularly acute where the gauge or the thickness of the web varies across the width thereof. Regions called gauge bands, which extend lengthwise of the web and are of relatively greater thickness, will form high spots on the product rolls when tightly rewound.

In other commercially available slitter-rewinder apparatus similar to that described above a set of rollers between the supply core and the product cores over which the web passes are powered to pull the material from the supply roll. This reduces the tension of the material at the product cores. However, as the product roll diameter increases the slippage between the product cores and the constant rpm takeup rollers increases. This friction generates heat which can damage the web material.

In U.S. Pat. No. 4,238,082 issued Dec. 9, 1980, there is described an improved slitter-rewinder apparatus in which the takeup rollers are rotatably driven by a first electric motor and the supply core check is rotatably driven by a second electric motor. The driving connection between the second electric motor and the supply core chuck includes intermeshing spur and worm gears, which driving connection prevents pulling forces exerted by the web portion extending between the supply and product cores from increasing the speed of rotation of the supply core. An electric control circuit is provided for independently varying the amount of electric current supplied to the first and second electric motors. The speed controls may take the form of rheostats which may be manually adjusted by control knobs. Also disclosed in that patent is a speed control system which includes means for sensing the amount of web that has been wound around the product cores and means responsive to the sensing means for automatically increasing the amount of current supplied to the second electric motor in a predetermined proportion to speed up the supply roll. In one form of the speed control system, a mechanism known as a dancer roll engages the outer surface of one of the product rolls. As the diameter of the product roll increases, the dancer roll arm assembly pivots and a mechanical linkage then transmits the pivoting motion to operate a rheostat or potentiometer to increase the amount of current supplied to the second electric motor and thereby increase the supply roll speed. Product rolls with uniformly aligned edges and without high spots are produced.

The control system described above which is disclosed in U.S. Pat. No. 4,238,082 represents a significant improvement over previous control systems for slitter-rewinder apparatus. However, it would be desirable to provide a system for controlling the supply and product roll speeds in a slitter-rewinder apparatus with even greater precision to further insure that product rolls which are produced with the apparatus have uniformly aligned edges and do not have high spots or material distortion.

SUMMARY OF THE INVENTION

It is therefore the primary object of the present invention to provide a system for more precisely controlling the roll speeds in a slitter-rewinder apparatus to insure that product rolls with uniformly aligned edges and without high spots or material distortion are produced.

It is another object of the present invention to provide a control system of the aforementioned type which controls supply roll speed by directly sensing roll rpm instead of sensing roll diameter.

The present invention provides a control system for a slitter-rewinder apparatus which forms a web of material into a plurality of individual rolls, the web being unwound from around a supply core and slit into strips which are rewound about a plurality of individual product cores. The slitter-rewinder apparatus has at least one takeup roller adapted to slidably receive the product cores there about. The supply core and the takeup roller are rotatably supported in spaced apart relationship with a portion of the web extending therebetween, around at least one idler roller and past a plurality of knives which cut the web into strips. The slitter-rewinder apparatus further has a first controllable motor for rotating the takeup roller and a second controllable motor for rotating the supply core. The control system includes a sensor for detecting the rotational speed of the product cores. The system also has control mechanisms responsive to the sensor for operating the second motor to cause the speed of the supply core to automatically increase and decrease in order to maintain a predetermined relationship between the speed of the product cores and the speed of the takeup roller throughout the rewinding process.

In the illustrated embodiment, an inductive sensor is mounted adjacent a tachometer plate secured to an end of one of the product cores. The inductive sensor is connected to an adjustable tachometer relay which operates a drive. The drive accelerates or decelerates the second motor in response to the opening and closing of the relay contacts to maintain the speed relationship that will produce the optimum web tension for insuring that product rolls with uniformly aligned edges and without high spots or material distortion are produced.

BRIEF DESCRIPTION OF THE DRAWINGS

In the figures like reference numerals refer to like parts unless otherwise indicated.

DESCRIPTION OF THE PREFERRED EMBODIMENT

Figure 1:
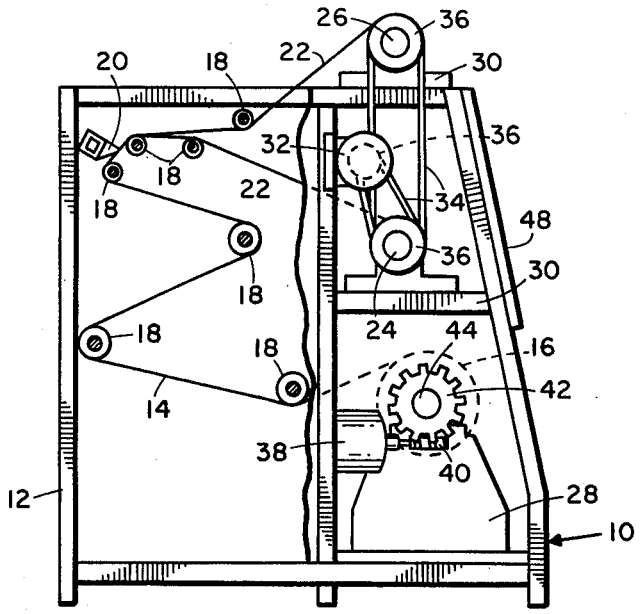
FIG. 1 is an end elevational view of a slitter-rewinder apparatus of the type in which the control system of the present invention may be utilized. In this view, portions are broken away, showing details of the drive mechanism and the manner in which a web of material is slit and rewound into product rolls.

Referring to FIG. 1, there is illustrated therein one form of a slitter-rewinder apparatus 10 of the type in which the control system of the present invention may be utilized. The apparatus includes an upright frame 12 made of interconnected horizontal and vertical steel box beams which are welded together to form a rigid supporting structure. A web 14 of sheet material is unwound from a relatively large supply roll 16 wound around an elongate cylindrical supply core not visible in the drawings.

As shown in FIG. 1, the web 14 is threaded from the supply roll 16 around a plurality of idler rollers 18 which guide the web past a plurality of horizontally spaced blades 20. The web 14 is slit by the blades into a plurality of strips 22. Adjacent ones of these strips are rewound about corresponding product cores (not visible in FIG. 1) carried by different ones of a pair of takeup rollers 24 and 26, in alternating fashion.

The slitter-rewinder apparatus 10 includes a pneumatically operated tail stock assembly at the far end of the supply roll (not visible in FIG. 1) and a fixed stock assembly 28 at the near end of the supply roll. Together these assemblies rotatably support the supply roll at its opposite ends. The ends of the takeup rollers 24 and 26 are rotatably journaled in bearing assemblies 30 secured to the frame 12. The set of bearing assemblies at the far end of the takeup rollers (not visible in FIG. 1) are mounted to a vertically hinged panel to permit one set of ends of the takeup rollers to be released. This allows a plurality of product cores and spacers to be manually slid onto and off of the takeup rollers. As is conventional, an alternating sequence of product cores and spacers on each of the takeup rollers may be clamped together endwise by a pneumatically operated clutch (not shown). The clutch may be of conventional design and may be operated by air pressure to move axially against the spacers to clamp the sequence of product cores and spacers endwise against the stop.

First controllable motor means are provided for rotating the takeup rollers 24 and 26 at various speeds. A first electric motor 32 is mounted to the frame 12 and is drivingly connected to the takeup rollers 24 and 26 by a pair of belts 34 entrained around pulleys such as 36 rigidly mounted to the ends of the motor shaft and the takeup rollers. The motor 32 may be a three phase AC motor. Three phase electric current can be supplied to the motor 32 to enable simultaneous powered rotation of the takeup rollers at the same speed for rewinding the strips 22 around the produce cores.

Second controllable motor means are provided for rotating the supply roll. A second electric motor 38, which may also be a three phase AC motor, is mounted to the lower portion of the frame 12. A worm gear 40 is connected to the shaft of the motor 38 and intermeshes with a spur gear 42 rigidly mounted to one end of the rotatable shaft 44 which supports the supply roll 16. Three phase electric current can be supplied to the second electric motor 38 to enable powered rotation of the supply roll 16. The ends of the shaft 44 are journaled in the tail and fixed stock assemblies at opposite ends of the frame.

Preferably, the worm and spur gears 40 and 42 (FIG. 1) are configured so that the supply roll 16 cannot be rotated as a result of the pulling forces exerted by the portion of the web 14 being unwound therefrom. This may be achieved by having the teeth of the spur gear 40 extend in an axial direction with respect to the shaft 44. In addition, the motor 38 is mounted at an angle offset from 90 degrees with respect to the shaft 44 so that the teeth of the worm gear and the spur gear are substantially parallel. This driving connection prevents over-spinning of the supply roll 16 which would reduce the tension of the portion of the web extending around the idler rollers below an acceptable level. Over-spinning tends to cause the strips 22 to weave laterally which results in product rolls having telescoping or other undesirable configurations. The intermeshing spur and worm gears prevent pulling forces exerted by the takeup rollers through the web from increasing the speed of rotation of the supply roll.

Figure 2:
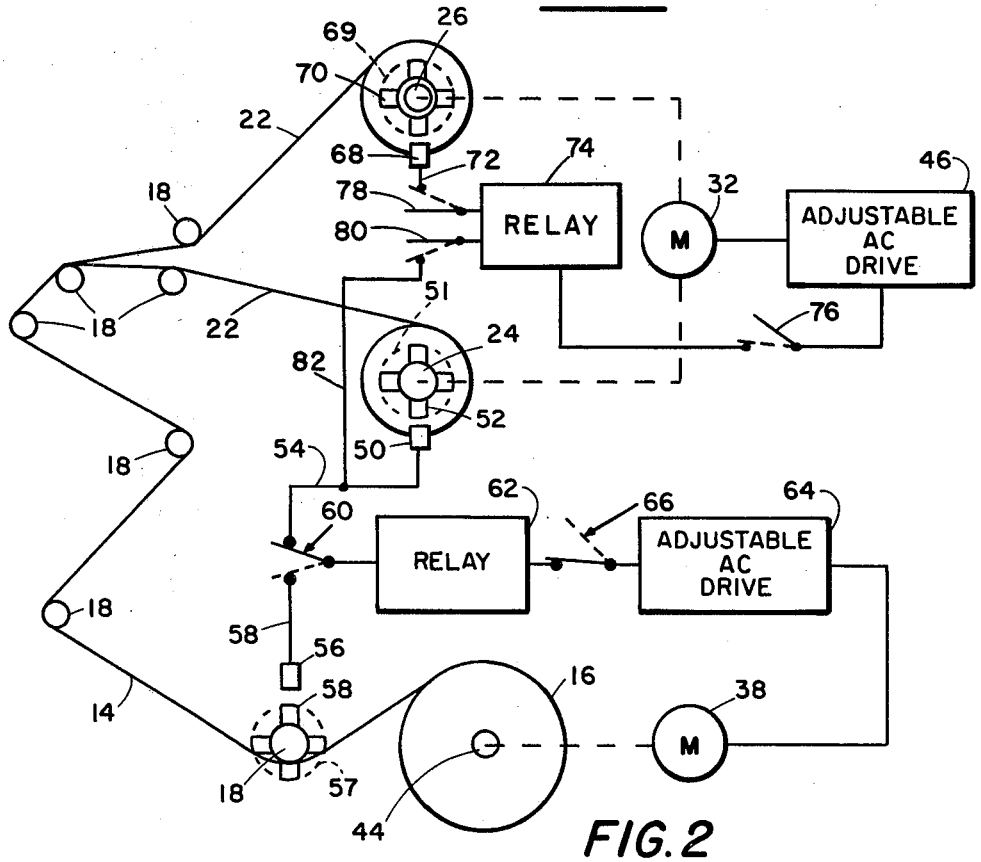
FIG. 2 is a schematic diagram of a preferred embodiment of the control system of the present invention.

Referring to FIG. 2, there is illustrated therein in schematic form a preferred embodiment of the control system of the present invention which controls the speed of the motors 32 and 38 to insure that lightweight stretchable web materials are evenly wound into precise rolls with a minimum amount of material distortion. The speed of the motor 32 is preset through an adjustable AC drive 46 so that the takeup rollers will rotate at a constant predetermined speed. It will be understood that where the motor 32 is a three phase AC motor, the drive 46 includes well known electronic circuitry for simultaneously varying the number of cycles per second of each of the three phases, and thus the speed of the motor. The controls for the drive 46 may be located on a control panel 48 (FIG. 1) secured to the upper portion of the left-front side of the frame 12.

A first inductive sensor 50 (FIG. 2) is mounted closely adjacent to a first radially extending tachometer plate 51 secured to one end of one of the product cores mounted on one of the takeup rollers 24 or 26. The plate 51 includes a plurality of circumferentially spaced, ferro-magnetic blocks 52. As each of the blocks 52 rotates past the adjacent end of the sensor 52, an electrical pulse is generated on a lead 54.

Similarly, a second inductive sensor 56 is mounted adjacent a second radially extending tachometer plate 57 rigidly mounted on one end of one of the idler rollers 18. The plate 57 also has a plurality of circumferentially spaced blocks 58 made of a ferro-magnetic material. As each of the blocks 58 rotates past an adjacent end of the second inductive sensor 56, a pulse is generated on a lead 58.

A two position switch 60 (FIG. 2) may be manually operated to selectively connect one of the leads 54 or 58 to the coil of a relay 62. The relay 62 is preferably of the type which is adapted to have its coil connected to an inductive sensor and may be adjusted so that a predetermined minimum number of pulses of a given amplitude will cause its contacts to close. Such relays are sometimes referred to as tachometer relays. One suitable relay which may be utilized is Model SF 150 manufactured and sold by Electromatic Company of Chicago, Illinois. Such adjustable or variable tachometer relays are sometimes utilized in conjunction with electricity producing windmills.

A second drive 64 is provided for controlling the current supplied to the motor 38 which drives the supply roll 16. Where the motor 38 is a three phase AC motor, the drive 64 is preferably an adjustable AC drive which may be pre-set via controls located on the control panel 48 (FIG. 1) to accelerate or decelerate the motor 38 (FIG. 2) at a predetermined rate. One suitable device for both the drives 46 and 64 is the LSI 9000 Solid State Adjustable Speed AC Drive manufactured by Precision Transformer, Inc., of Fullerton, California. That unit is available with separate acceleration rate, deceleration rate, and rpm controls. The acceleration and deceleration controls of the two units 46 and 64 may be separately adjusted so that the three phase current supplied to the motors 32 and 38 will increase or decrease at a chosen rate in the range of, for example, 1.2 to 36 Hertz per second. The rpm limit controls may be adjusted to set the minimum or maximum rpm beyond which the motors will not be accelerated or decelerated.

The output of the relay 62 is connected through a manual switch 66 to the controls of the adjustable AC drive 64 so that when the contacts of the relay are open, the motor 38 is accelerated at a preselected rate, and when the contacts of the relay are closed, the motor 38 is decelerated at a preselected rate. When the switches 60 and 66 are in their positions shown in solid lines in FIG. 2, the drive 64 senses the speed of the product cores and controls the supply roll speed in response thereto. The web 14 is fed just fast enough to maintain the optimum web tension or desired slip rate between the product cores and the takeup rollers throughout the rewinding process that will result in perfect product rolls. This control is accomplished without utilizing any mechanisms which physically touch the web, such as a dancer roll which monitors the diameter of one of the rolls.

A third inductive sensor 68 is mounted adjacent a third radially extending tachometer plate 69 rigidly mounted on one end of the takeup roller 26. The plate 69 also has a plurality of circumferentially spaced blocks 70 made of a ferro-magnetic material, e.g. steel blocks. As each of the blocks 70 rotates past an adjacent end of the third inductive sensor 68, a pulse is generated on a lead 72. Another tachometer relay 74 has its output connected through a manual switch 76 to the drive 46. This relay is of the type known as a speed synchronizer and is commercially available. It is an adjustable comparator relay, one type of which is available from Gould Electronics. The relay 74 has a pair of inputs. One of these is connectable to the sensor 68 through a manual switch 78. The other input is connectable to the sensor 50 through a manual switch 80 and a lead 82.

A first mode in which the control system operates may now be described in greater detail. First, the supply roll 16 is mounted between the tail stock and fixed stock assemblies of the apparatus. An alternating sequence of product cores and spacers are slid over the takeup rollers as previously described. Preferably, the product core with the tachometer plate 51 secured to one end thereof is located at the end of the takeup roller 24. The pneumatic clutches are operated to clamp the product cores and spacers together with a predetermined amount of pressure. The end of the web is manually threaded from the supply roll, about the idler rollers and past the blades which slit the web into a plurality of strips. The ends of the strips are then affixed with adhesive tape or in some other suitable fashion to their corresponding product cores.

The switches 60 and 66 are moved to their positions shown in solid lines in FIG. 2. The switches 78 and 80 are moved to their positions shown in solid lines. The drives 46 and 64 and the relay 62 are adjusted to obtain optimum speed control. This will depend upon the type of material being slit and rewound, for example, acetate, paper, etc. The drive 46 is set to run the takeup rollers at a constant rpm. During the rewinding process, the product cores slip relative to the takeup rollers. The amount of slippage depends upon the setting of the speed at which the web is supplied from the supply roll. As an example, if the product cores rotate at approximately 190 rpm when the takeup rollers are rotating at approximately 200 rpm throughout the rewinding process, this will insure that the product rolls will have uniformly aligned edges and will not have high spots or material distortion. Assuming that this relationship is desired, the relay 62 is adjusted so that its contacts will close when the speed of the product cores exceeds 190 rpm. Correspondingly, the contacts of the relay will then open when the speed of the product cores falls below 190 rpm. The drive 64 is adjusted to accelerate and decelerate the supply roll at predetermined rates in order to maintain, as closely as possible, rotation of the product cores at approximately 190 rpm as the diameter of the product rolls increases and the diameter of the supply roll decreases.

As soon as the drives 46 and 64 and the relay 62 are set, the motor 32 is started. At this point, the supply roll is not immediately powered. The product cores and the strips remain stationary and the takeup rollers spin within the product cores. Next, the drive 64 is activated to start rotation of the supply roll. The motor 38 and the supply roll 16 rotate at ever increasing rpm. The frictional engagement between the product cores and the takeup rollers is sufficient so that the product cores start to rotate to rewind strips there around. In a few seconds the product cores exceed 190 rpm, causing the contacts of the relay 62 to close. This in turn causes the drive 64 to decelerate the supply roll 16 at a predetermined rate. When the speed of the product cores falls below 190 rpm, the contacts of the relay 62 open. This causes the drive 64 to once again accelerate the motor 38 and the supply roll at a predetermined rate to bring the speed of the product cores back up to 190 rpm. Speed is checked a couple of times per second. By this method of feedback control, optimum web tension is maintained throughout the entire rewinding process so that the desired product rolls are produced.

In some instances, it may be desirable to maintain a constant web speed, for example, 500 feet per minute. This may be accomplished by operating the apparatus in a second mode. The switch 60 (FIG. 2) is moved to its position shown in phantom lines so that the sensor 56 can be utilized to monitor the speed of one of the idler rollers 18 to which the tachometer plate 57 is rigidly mounted. The switches 78 and 80 are moved to their positions shown in phantom lines to connect the sensors 72 and 50 to the speed synchronizer relay 74. The switch 76 is closed. The output of the relay 74 is connected to the drive 46 so that opening and closing of the relay contacts will cause acceleration and deceleration of the takeup rollers. The drives 46 and 54 and the relays 62 and 74 may then be adjusted so that throughout the rewinding operation a constant web speed is maintained with the desired web tension. The relay 74 is preset so that it will control the speed of the motor 32 to maintain the takeup roller speed and product core speed within, for example, 20% of each other. Such a control may be desirable where a coating is being applied during the rewinding operation.

Having described a preferred embodiment of the control system for a slitter-rewinder apparatus, it should be apparent to those skilled in the art that our invention may be modified in both arrangement and detail. Therefore, the protection afforded our invention should be limited only in accordance with the scope of the following claims.

We claim:

1. A control system for a slitter-rewinder apparatus which forms a web of material into a plurality of individual rolls, the web being unwound from around a supply core and slit into strips which are rewound about a plurality of individual product cores, the apparatus having at least one takeup roller adapted to slidably receive the product cores thereabout, means for rotatably supporting the supply core and the takeup roller in spaced apart relationship with a portion of the web extending therebetween, around at least one idler roller and past a plurality of knives for cutting the web into strips, first controllable motor means for rotating the takeup roller and second controllable motor means for rotating the supply core, the control system comprising:

sensor means for detecting the rotational speed of the product cores; and control means responsive to the sensor means for operating the second controllable motor means to cause the speed of the supply core to automatically increase and decrease in order to maintain a predetermined relationship between the speed of the product cores and the speed of the takeup roller throughout the rewinding process.

2. A control system according to claim 1 wherein:

the sensor means includes a tachometer plate secured to one end of one of the product cores and an inductive sensor mounted adjacent the tachometer plate for generating signals representative of the rotational speed of the product core as the tachometer plate rotates past the inductive sensor;

an adjustable tachometer relay having its coil connected to the inductive sensor and a pair of contacts adapted to close when the rotational speed of the product cores exceeds a preset level and open when the rotational speed of the product cores falls below the preset level;

an adjustable drive connected to the contacts of the relay for increasing the speed of the second controllable motor means at a preset acceleration rate when the relay contacts are open, and for decreasing the speed of the second controllable motor means at a preset deceleration rate when the relay contacts are closed.

3. A control system according to claim 1 and further comprising:

second sensor means for detecting the rotational speed of the idler roller; and switch means for selectively connecting one of the two sensor means to the control means.

4. A control system according to claim 2 and further comprising:

a second tachometer plate secured to the idler roller and a second inductive sensor mounted adjacent the second tachometer plate for generating signals representative of the rotational speed of the idler roller as the second tachometer plate rotates past the second inductive sensor; and a switch for selectively connecting one of the inductive sensors to the tachometer relay.

5. A control system according to claim 2 wherein:

the second controllable motor means includes a three phase AC motor, means for providing a rotating drive connection between the motor and the supply core; and the adjustable drive is adapted for supply three phase signals in varying frequencies to the motor.

6. A control system according to claim 5 wherein the driving connection means includes intermeshing spur and worm gears adapted to prevent pulling forces exerted on the portion of the web extending between the supply core and the product cores from increasing the speed of the supply core.

7. A control system according to claim 4 and further comprising:

a third tachometer plate secured to the takeup roller and a third inductive sensor mounted adjacent the third tachometer plate for generating signals representative of the rotation speed of the takeup roller as the third tachometer plate rotates past the third inductive sensor;

an adjustable comparator relay;

switch means for selectively connecting the inputs of the comparator relay to the first and third sensors; and a second adjustable drive connected to the output of the comparator relay for increasing and decreasing the speed of the first controllable motor means at preset acceleration and deceleration rates in accordance with the output of the comparator relay.

* * * * *